US006425609B2

(12) United States Patent
Cheng

(10) Patent No.: US 6,425,609 B2
(45) Date of Patent: Jul. 30, 2002

(54) LOCKING DEVICE FOR A CHILD SAFETY DOOR

(76) Inventor: Shu-Chen Cheng, 3rd Fl., No. 100, Wenlin N. Rd., Taipei (TW)

( * ) Notice: Subject to any disclaimer, the term of this patent is extended or adjusted under 35 U.S.C. 154(b) by 0 days.

(21) Appl. No.: 09/790,386

(22) Filed: Feb. 21, 2001

(30) Foreign Application Priority Data

Feb. 25, 2000 (TW) ..... 89203050 U

(51) Int. Cl.[7] ..... E05C 5/00
(52) U.S. Cl. ..... 292/5; 292/63; 292/64
(58) Field of Search ..... 292/5, 63, 64, 292/66, 67; 49/55, 57, 463

(56) References Cited

U.S. PATENT DOCUMENTS 5,442,881 A * 8/1995 Asbach et al. ..... 49/465
5,906,068 A * 5/1999 Bode ..... 49/55
5,924,242 A * 7/1999 Macari ..... 49/55
6,112,461 A * 9/2000 Cheng ..... 49/55

* cited by examiner

*Primary Examiner*—Teri Pham Luu
(74) *Attorney, Agent, or Firm*—Jackson Walker L.L.P.

(57) ABSTRACT

A locking device for use with a child safety door has a press bar (24) pivotally received in a housing (21), a first latch (22) pivotable in relation to the housing (21) and having an end (222) securely engaged with a first end (242) of the press bar (24), a handle (26) pivotally received in the housing (21) and having an abutting block (263) and a second latch (23) slidably received inside the housing (21) and operatably connected with the handle (26). With such an arrangement, the press bar (24) and the handle (26) are able to control the locking/unlocking mode between the door (14) and the doorframe (10) of the safety door.

2 Claims, 7 Drawing Sheets

LOCKING DEVICE FOR A CHILD SAFETY DOOR

BACKGROUND OF THE INVENTION

1. Field of the Utility Model

The present utility model relates to a locking device, and more particularly to a locking device for a child safety door. The locking device has a first latch and a second latch adapted to be detachably received in holes in a doorframe to selectively lock the safety door.

2. Description of Related Art

With reference to FIGS. 6 and 7, a conventional safety door is shown. Normally, the safety door has a U-shaped frame (30), a door (40) pivotally connected with the frame (30) and a locking assembly (50) provided in the door (40) to secure the engagement between the door (40) and the frame (30).

The locking assembly (50) has a housing (51) with a first latch (52) movably received in the housing (51) to correspond to a first hole (31) and a second latch (53) pivotally received in the housing (51) to correspond to a second hole (32) of the frame (30). The locking assembly (50) further has a control handle (55) pivotally connected with the housing (51) by means of a torsion spring (56), a retaining cam (54) securely engaged with the control handle (55) and having an extension (541) formed with the retaining cam (54) and operatably engaged with the first latch (52) and a lever (57) opposite to the first latch (52) and pivotally received in the housing (51) and a first end of which extends out of the housing (51) and a second end of which engages with a free end of the second latch (53).

When the conventional lock assembly (50) is in a lock mode, the first and second latches (52,53) are received in the first and second holes (31,32) of the frame (30) respectively so that the engagement between the door (40) and the frame (30) is secured and a child is safely guarded from danger by the safety door. When unlocking, the user will have to pivot the control handle (55) to drive the retaining cam (54) to pivot simultaneously in a clockwise direction so that an abutment of the extension (541) to the first latch (52) is released. After the abutment of the extension (541) of the retaining cam (54) is released, due to the provision of a first spring (59) in the first latch (52), the first latch (52) retrogrades from the first hole (31) such that a first locking relationship between the door (40) and the frame (30) is released. Furthermore, the user still needs to lifts the lever (57) in a clockwise direction to drive the second latch (53) is a counterclockwise direction, so that the second latch (53) leaves the second hole (32) of the frame (30) to release the second locking relationship between the door (40) and the frame (30). After the lift to the lever (57), the lever (57) resumes to its original position because of a second spring (58). With the two latches (52,53), the locking assembly (50) does provide a secure engagement between the door (40) and the frame (30). However, the locking assembly involves too many elements in locking and unlocking modes and therefore, the cost for manufacturing the locking assembly is high.

To overcome the shortcomings, the present utility model tends to provide an improved locking device for a child safety door to mitigate and obviate the aforementioned problems.

SUMMARY OF THE INVENTION

The objective of the utility model is to provide an improved locking device to secure the engagement between a door and a frame. The locking device is provided with a first locking unit and a second locking unit.

In accordance with one aspect of the utility model, the first locking unit has a press bar operatably connected with a first latch and a handle operatably connected with a second latch. The first latch is detachably received in a first hole in a frame and the second latch is detachably received in a second hole in the frame, such that the engagement between a door and the frame is secured.

Other objects, advantages and novel features of the utility model will become more apparent from the following detailed description when taken in conjunction with the accompanying drawings.

DETAILED DESCRIPTION OF THE PREFERRED EMBODIMENT

Figure 1:
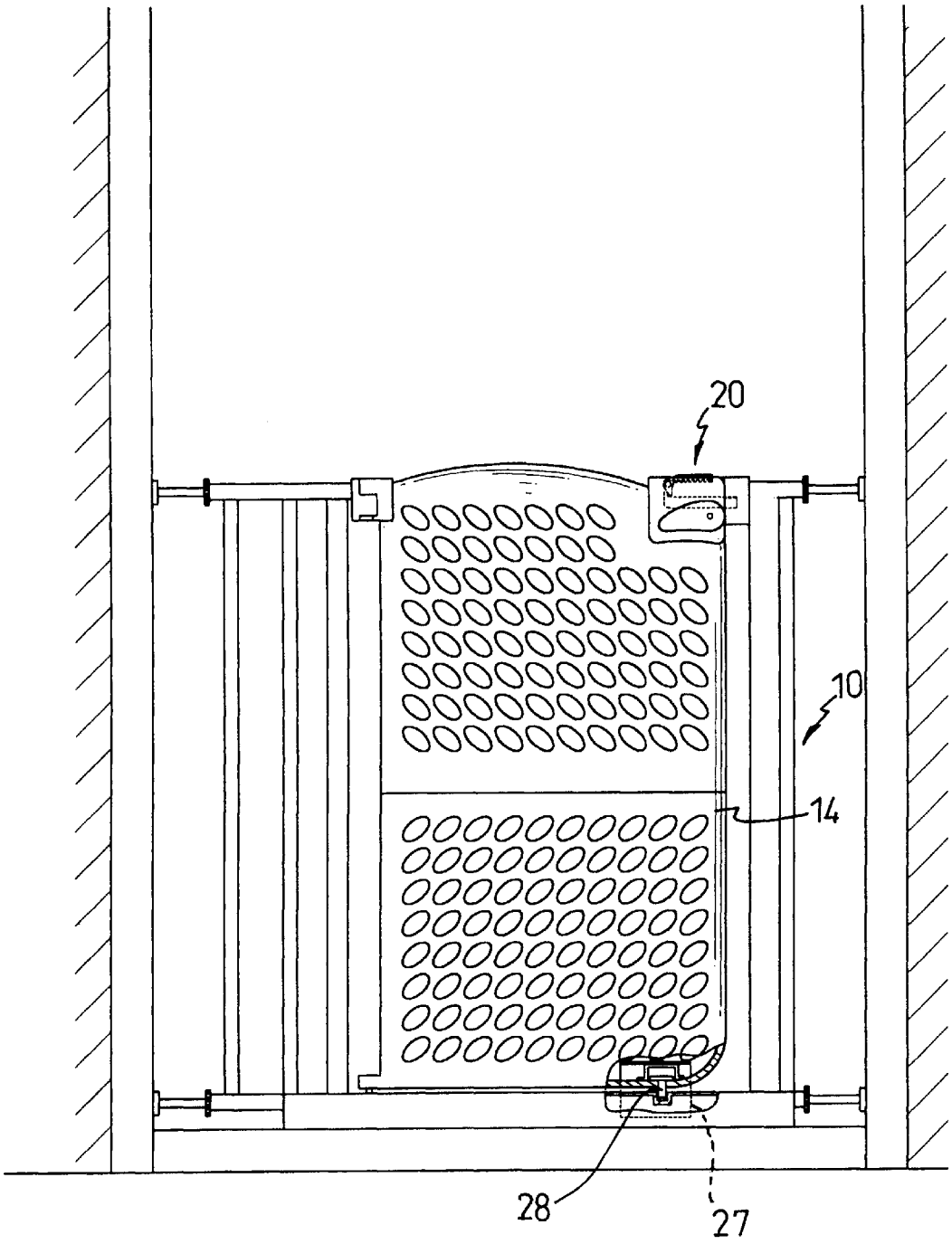
FIG. 1 is a side plan view of the locking device incorporated with a doorframe and a door inside the doorframe.

With reference to FIG. 1, a child safety door is composed of a doorframe (10) with a door (14) pivotally received in the doorframe (10) and a locking device (20) to secure the engagement between the doorframe (10) and the door (14).

Because the doorframe (10) and the door (14) is conventional in the art, detailed description thereof is thus omitted.

Figure 2:
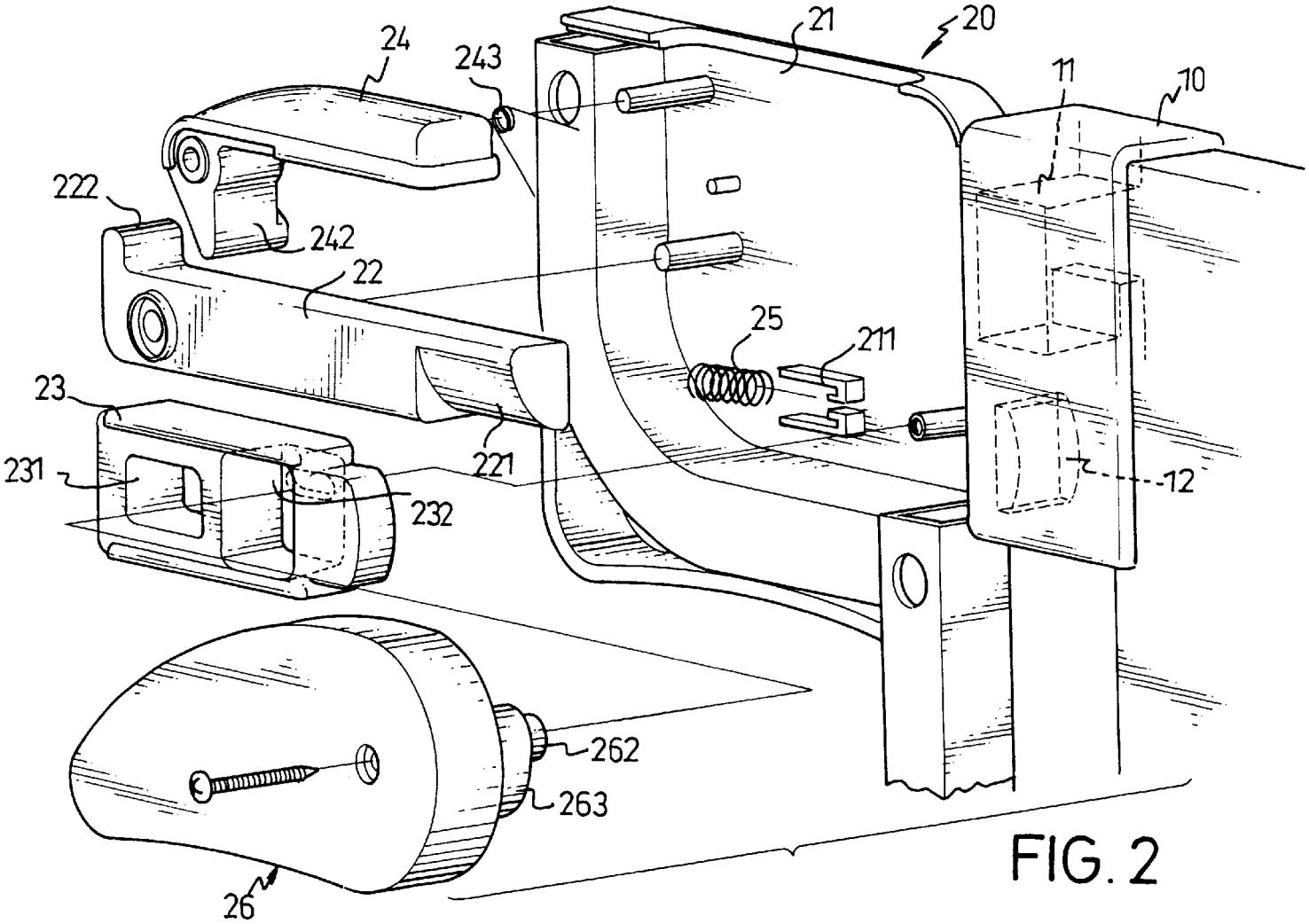
FIG. 2 is an exploded perspective view of the locking device in accordance with the present utility model.

With reference to FIG. 2, the locking device (20) constructed in accordance with the present utility model has a housing (21) securely received in a top edge of the door (14) and engaged with the doorframe (10), a first locking unit having a pressing bar (24) pivotable in relation to the housing (21) and a first latch (22) also pivotable with respect to the housing (21) and provided with a first end (221) adapted to be detachably received in a first hole (11) of the doorframe (10) and a second end (222) extending out to engage with a protruding end (242) of the press bar (24) and a second locking unit having a handle (26) pivotable with respect to the housing (21) and a second latch (23) operatably connected with the handle (26) and slidably movable with respect to the housing (21).

The handle (26) has a shaft (262) extending out to pivotally engaged with the housing (21) and an abutting block (263) engaged with the second latch (23).

The second latch (23) which is slidably received inside the housing (21) and detachably received in a second hole (12) in the doorframe (10) has a sliding hole (231) defined to receive a guide (211) formed on a face of the housing (21) so that the second latch (23) is able to slide inside the housing (21) by the guidance of the guide (211) and a through hole (232) defined to receive therein the abutting block (263). A first spring (243) is provided between the housing (21) and the press bar (24) to ensure that the press bar (24) resumes its original position after being pivoted and a second spring (25) is provided between the guide (211) and the second latch (23) to provide a force to the second latch (23) to leave the limitation of the second hole (12) of the doorframe (10).

Figure 3:
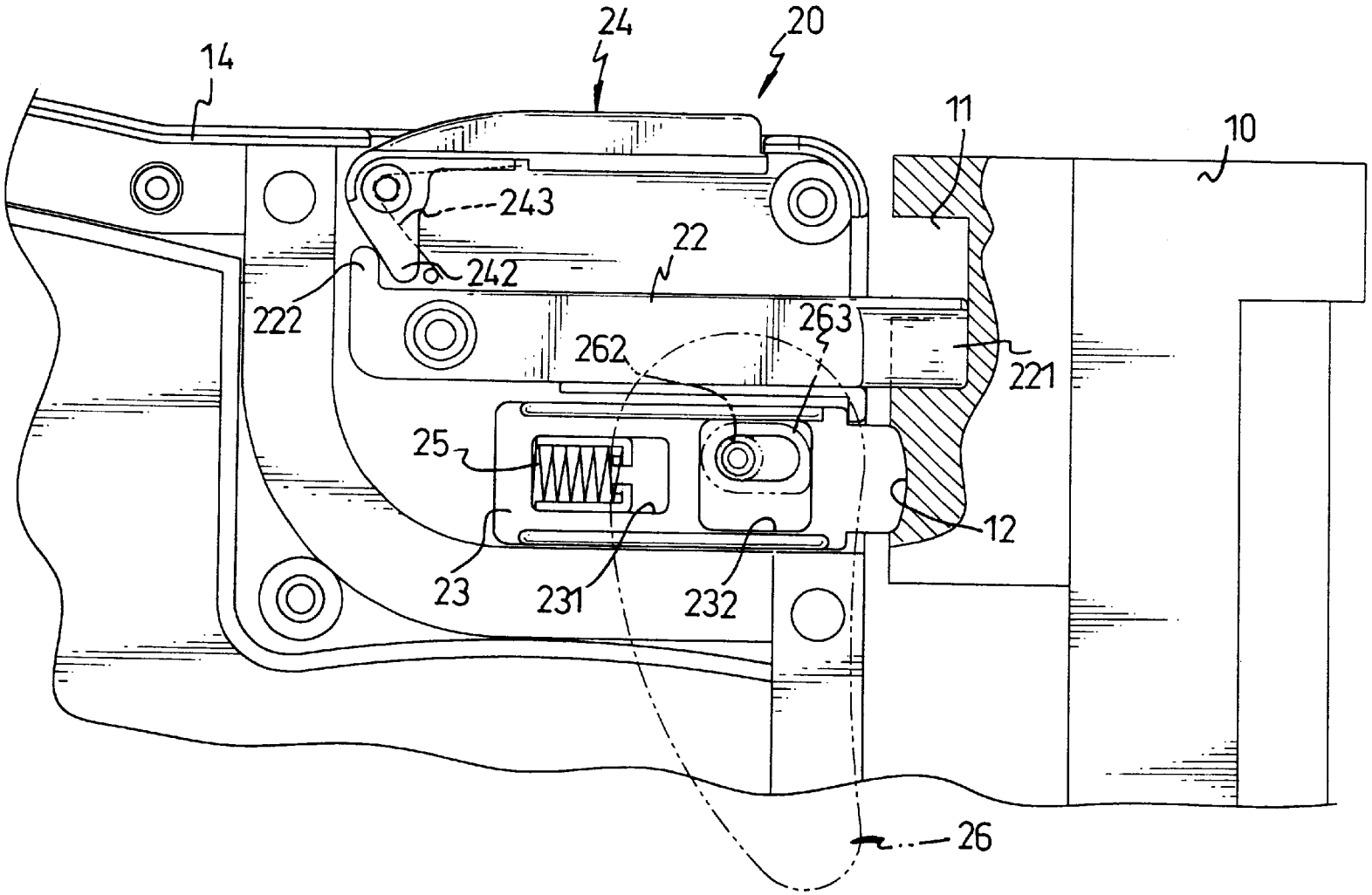
FIG. 3 is an enlarged side plan view of the assembled locking device incorporated with the doorframe.
Figure 4:
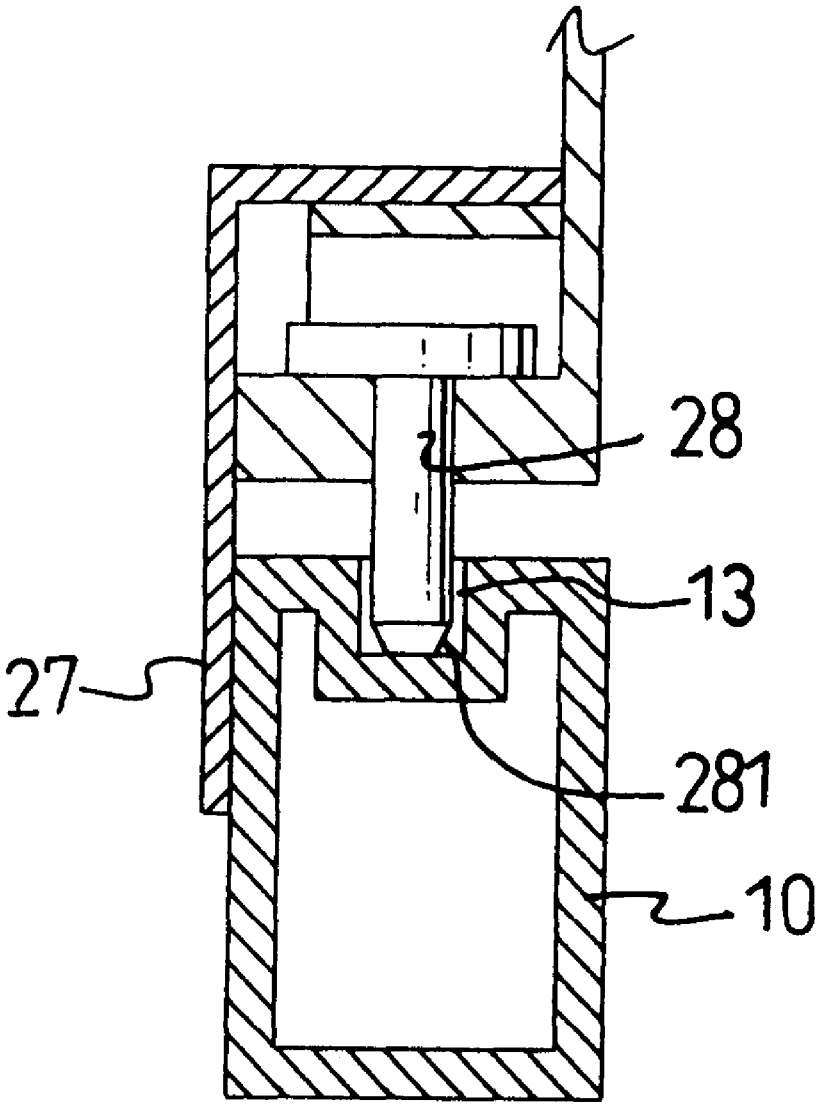
FIG. 4 is a side plan view with a part in section showing a further retainer to secure the engagement between the doorframe and the door.

With reference to FIG. 3, it is noted that after the assembly of the locking device (20) of the present utility model, the protruding end (242) of the press bar (24) of the first locking unit engages with a second end (222) of the first latch (22), wherein the first spring (243) is provided between the housing (21) and the press bar (24) to provide a recovery force to the press bar (24). The abutting block (263) abuts against a side face defining the through hole (232) and the second spring (25) is provided to abut between the guide (211) and a side face defining the sliding hole (231). Furthermore, from the referenced drawings, it is noted that before the actuation of the press bar (24) and the handle (26), the first latch (22) is received in the first hole (11) and the second latch (23) is received in the second hole (12) of the doorframe (10), thus the locking device of the present utility model is in a locking mode.

Figure 5:
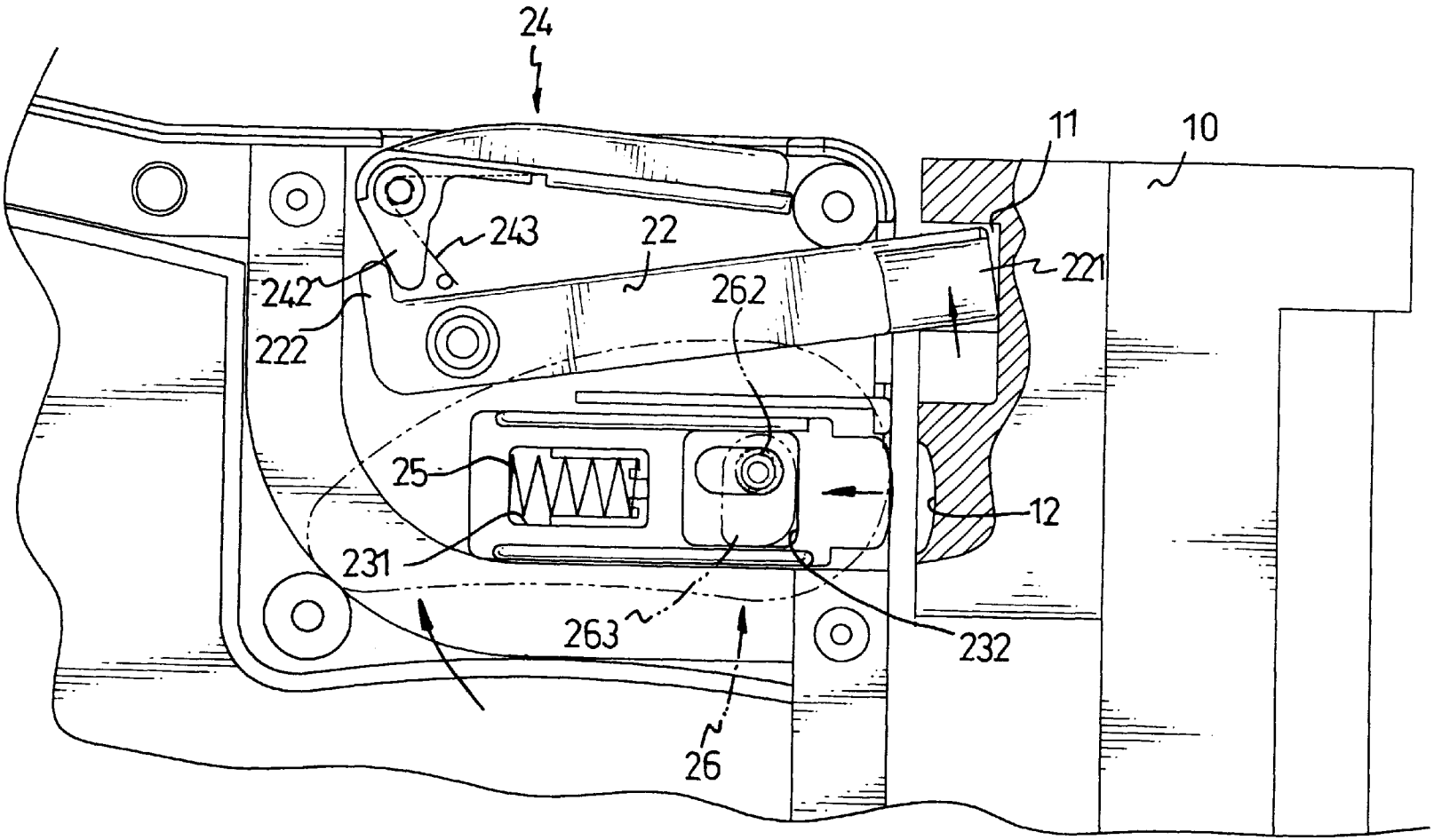
FIG. 5 is an enlarged operational plan view of the movement of the first and the second locking units in relation to the doorframe.
Figure 6:
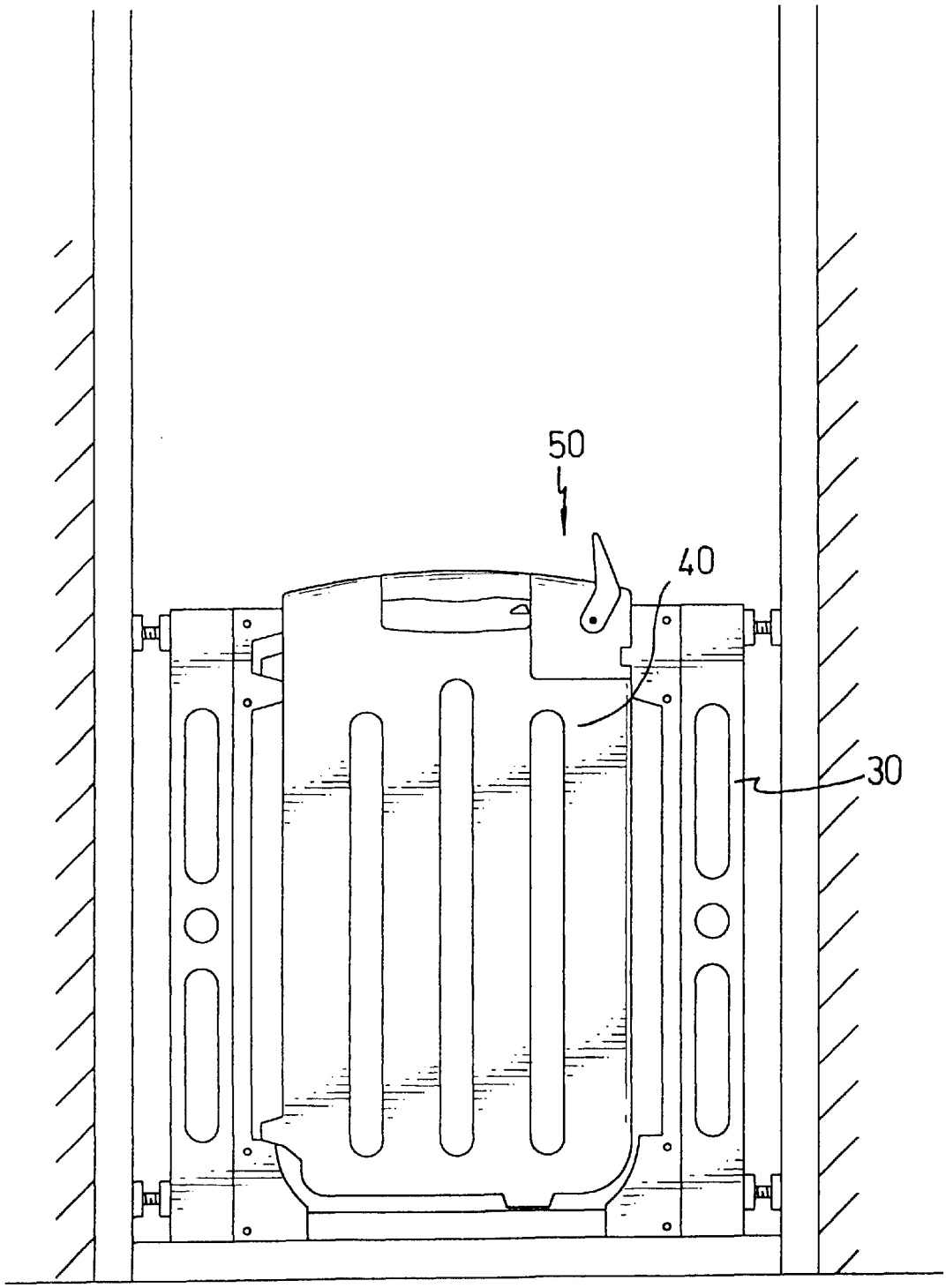
FIG. 6 PRIOR ART
FIG. 6 is a side plan view of a doorframe and a door inside the doorframe with a conventional locking assembly inside the door.
Figure 7:
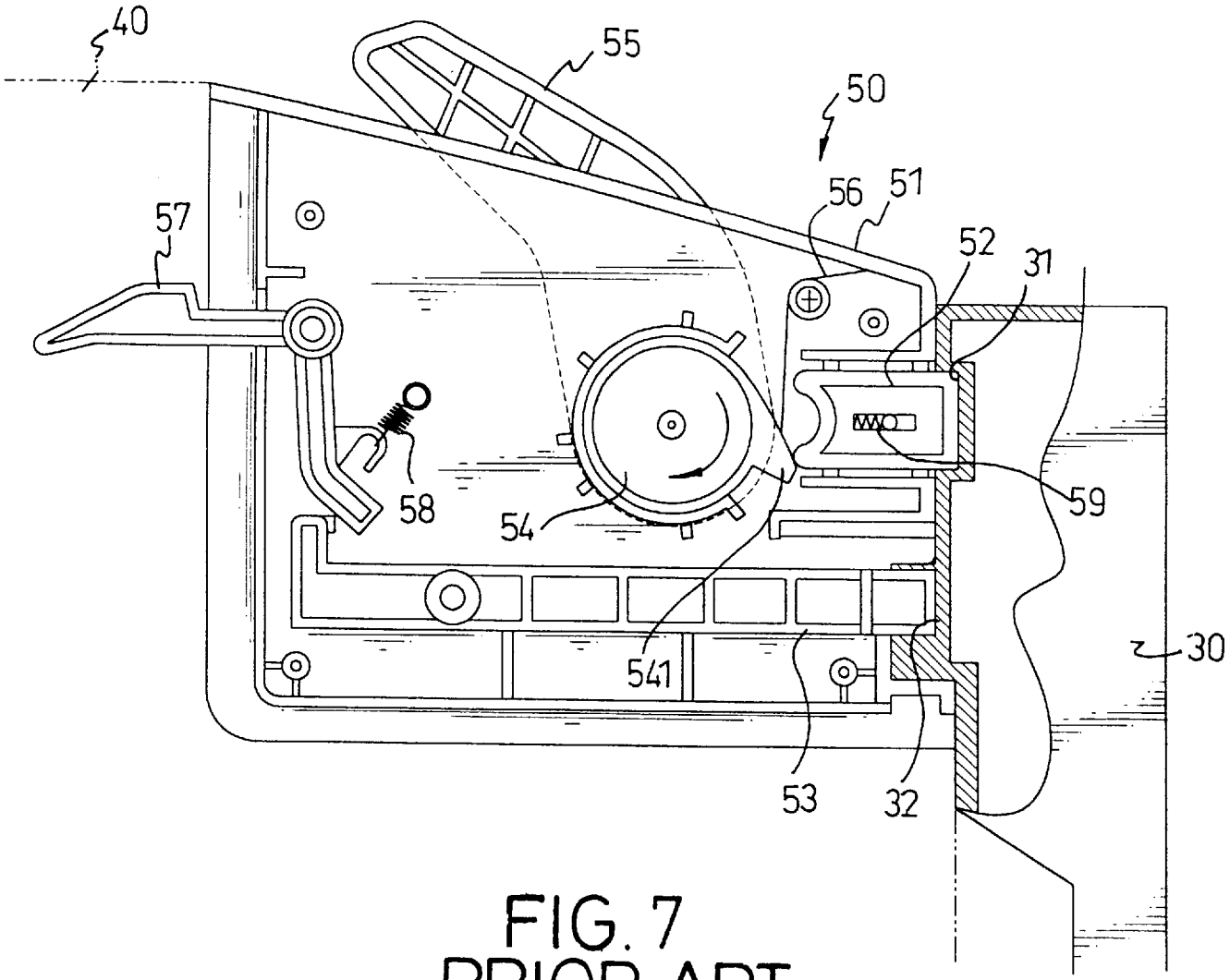
FIG. 7 PRIOR ART
FIG. 7 is an enlarged operational side plan view of the conventional locking assembly in relation to the doorframe.

With reference to FIG. 5, when unlocking the engagement between the door (14) and the doorframe (10), the user presses the press bar (24) to pivot the first latch (22) and the first latch (22) leaves the limitation from the first hole (11) of the frame (10). Meanwhile, the user pivots the handle (26) to allow the abutting block (263) to push the side face defining the through hole (232), so that the second latch (23) leaves the second hole (12) and the second spring (25) stretches inside the sliding hole (231). After both the first and second latches (22,23) leave the first and second holes (11,12) respectively, the door (14) leaves the limitation of the doorframe (10). It is noted that both the press bar (24) and the handle (26) are mounted close to each other, so that the user is able to operate both elements simultaneously without using both hands to operate two different elements that are far away from each other as described in the prior art.

Furthermore, the door (14) may also provide with a pin (28) extendably located under a baffle (27) that is securely connected with a bottom face of the door (14). The pin (28) has a head with an oblique periphery (281). In order to secure the door (14) with respect to the doorframe (10), a pin hole (13) is defined in a face of the doorframe (10) to correspond to the pin (28), such that the pin (28) is able to use the oblique periphery (281) to easily enter and leave the pin hole (27) so as to secure and free the engagement between the doorframe (10) and the door (14).

It is to be understood, however, that even though numerous characteristics and advantages of the present utility model have been set forth in the foregoing description, together with details of the structure and function of the utility model, the disclosure is illustrative only, and changes may be made in detail, especially in matters of shape, size, and arrangement of parts within the principles of the utility model to the full extent indicated by the broad general meaning of the terms in which the appended claims are expressed.

What is claimed is:

1. A locking device that is mounted on a door of a child safety door, the locking device comprising:

a hollow housing;

a first locking unit having:

a press bar pivotally received in the housing by means of a first spring; and a first latch pivotal in relation to the housing and having a first end adapted to be detachably received in a doorframe and a second end securely engaged with an end of the press bar;

a second locking unit having:

a handle pivotally received in the housing and provided with an abutting block integrally formed with the handle; and a second latch slidably received in the housing and defining therein a sliding hole for receiving therein a guide integrally formed on a face of the housing and a through hole for receiving therein the abutting block;

whereby the pivotal movement of the press bar drives the first latch to detachably received inside the doorframe and the pivotal movement of the handle drives the second latch to slidably received in the doorframe, such that the engagement between a door and the doorframe is secured.

2. The locking device as claimed in claim 1 further comprising a pin extendably received under the door and provided with an oblique periphery on a free end of the pin, so that the pin is able to be selectively received in a corresponding pin hole in the doorframe.

* * * * *